US005869816A

United States Patent [19]

Strack et al.

[11] Patent Number: 5,869,816

[45] Date of Patent: Feb. 9, 1999

[54] APPARATUS AND METHOD FOR CONTINUOUS PROCESSING OF GRANULAR MATERIALS USING MICROWAVES

[75] Inventors: J. Terry Strack; Ibrahim Balbaa, both of Mississauga; Bruce T. Barber, Milton, all of Canada

[73] Assignee: Ontario Hydro, Toronto, Canada

[21] Appl. No.: 536,711

[22] Filed: Sep. 29, 1995

[51] Int. Cl.[6] ..... H05B 6/78

[52] U.S. Cl. ..... 219/687; 219/701; 219/693; 34/259

[58] Field of Search ..... 219/693, 687, 219/690, 698, 699, 700, 701, 697, 710; 34/259, 264

[56] References Cited

U.S. PATENT DOCUMENTS

| | | | |
|---|---|---|---|
| 3,277,580 | 10/1966 | Tooby | 219/701 |
| 3,611,582 | 10/1971 | Hamid et al. | 219/693 |
| 3,626,838 | 12/1971 | Gorakhpurwalla | 219/699 |
| 4,004,122 | 1/1977 | Hallier | 219/697 |
| 4,737,610 | 4/1988 | Kotsch et al. | 219/693 |
| 4,908,486 | 3/1990 | Fry | 219/697 |
| 5,191,183 | 3/1993 | Balbaa . | |
| 5,227,598 | 7/1993 | Woodmansee | 219/10.55 |
| 5,367,147 | 11/1994 | Kim et al. | 219/698 |

FOREIGN PATENT DOCUMENTS

| | | |
|---|---|---|
| 2008242 | 7/1991 | Canada . |
| 49-117847 | 10/1974 | Japan . |
| AU90/00015 | 1/1990 | WIPO . |
| US91/00216 | 1/1991 | WIPO . |

*Primary Examiner*—Philip H. Leung
*Attorney, Agent, or Firm*—Ridout & Maybee

[57] ABSTRACT

An apparatus and method for the continuous processing of a granular material in a wet or dry state. The apparatus comprises first and second heating chambers, and the heating energy is provided by microwave energy. The first chamber preheats the granular material to lower the moisture content. The second chamber heats the granular material to the desired high temperature, for example, 800° C. for the reactivation of carbon. The first and second chambers are arranged in a vertical orientation to allow gravity to assist in the flow of material through the chambers. The flow of material is controlled by a valve positioned at the outlet of the second chamber. The apparatus is suitable for the reactivation of metallurgical carbon and the heating of other granular materials such as ceramics and glass powders.

14 Claims, 2 Drawing Sheets

APPARATUS AND METHOD FOR CONTINUOUS PROCESSING OF GRANULAR MATERIALS USING MICROWAVES

FIELD OF THE INVENTION

The present invention relates to an apparatus for processing granular material using microwave energy. In particular, this invention relates to an apparatus for continuous and uniform heating of wet and/or dry granular material using microwave energy.

BACKGROUND OF THE INVENTION

Activated carbon is commonly used in metallurgical processing, for example in the extraction of gold from ore. During the processing the carbon becomes contaminated through the clogging of pores in the carbon with impurities and the carbon needs to be reactivated before it can be used again. For reactivation, the carbon is heated to a temperature of approximately 700° C. (i.e. the reactivation temperature) over a period of approximately 60 minutes. The heating burns the impurities which have been absorbed by the carbon.

Heating devices which are presently in use for reactivating carbon comprise gas fired kilns and electric resistance furnaces. In order to thoroughly heat the carbon, conventional gas fired kilns and electric resistance furnaces typically comprise a rotary kiln. The batch of carbon is placed in the rotary kiln and the kiln is rotated during the heating cycle in an attempt to uniformly heat the carbon. To provide uniform heating, known kiln furnaces typically include a blower which forces heated air or gas over the carbon material, which means that the furnace must have additional capacity to heat the make-up air. The advantage of the rotary kiln is reactivation of a greater percentage of the carbon in the batch is usually achieved. The disadvantage however is the mechanical breakdown of the carbon, caused by abrasion during rotation, which renders a portion of the carbon unusable due to the smaller size of the carbon. Furthermore, the addition of a blower increases the cost of the system.

In the art, vertical kiln furnaces are also known for processing carbon. Vertical kiln furnaces comprise a vertical heating chamber which is supplied with carbon through a feed tube at the top. The heating chamber includes external heating sources which heat the carbon inside the chamber. In such a furnace, the vertical flow of carbon through the heating chamber is controlled and the applied heat energy raises the temperature of the carbon to burn the impurities. The moisture and impurities which are released from the carbon tend travel up and accumulate at the top of the vertical kiln. The accumulation of moisture can cause condensation problems and the collection of impurities which may include volatile games can present a hazard, for example, due to possibility of spontaneous combustion. The accumulation at the top of such conventional vertical kilns can also clog the feed tube supplying the carbon Another disadvantage associated with conventional vertical kiln furnaces is the limitation on the width of the heating chamber and therefore the throughput of the kiln. The width of the heating chamber is limited by the thermal conductivity of the material, e.g. carbon, being heated inside the kiln.

Other disadvantages associated with conventional kilns include the need to maintain the kiln at a high temperature even during idle periods. Because there is a lag time to raise the temperature in the furnace, the furnace is typically kept at an elevated temperature during idle periods in order to provide an acceptable response time when loaded with material for processing. It will be appreciated that continuously maintaining the furnace at an elevated temperature can consume considerable energy.

The present invention overcomes these disadvantages. The present invention utilizes a microwave energy source to directly heat the granular material, e.g. carbon, in a two-chamber apparatus. The first chamber provides a drying and preheating zone in which the material is heated to a first temperature in order to decrease the moisture content and for some materials, e.g. ceramics, increase the microwave coupling of the material. The benefits of microwave heating, i.e. rapid heating with lower energy consumption, are realized in the second chamber where further microwave heating is applied to the material to reach the reactivation or regeneration temperature. The present invention also provides an apparatus for continuously heating the granular material.

BRIEF SUMMARY OF THE INVENTION

The present invention provides an apparatus for the continuous processing of granular materials which can be in a dry or wet state.

In a first aspect, the present invention provides an apparatus far continuous processing of granular material, said apparatus comprising: (a) a microwave chamber having a port for receiving microwave energy and an inlet for receiving said granular material and an outlet for releasing granular material; (b) a vessel located inside said microwave chamber and in communication with said inlet for receiving said granular material and exposing said granular material to microwave energy; (c) said vessel including an output in communication with said outlet for releasing said granular material; and (d) a control valve coupled to said outlet for controlling the flow of granular material through said vessel.

In a second aspect, the present invention provides a method for heating a granular material in a microwave chamber having first and second vessels and a port for receiving microwave energy and an input for receiving the granular material and an output for releasing the granular material, said method comprising the steps of: (a) continuously feeding granular material to said first vessel and feeding granular material from said first vessel to said second vessel; (b) supplying microwave energy to said microwave chamber for heating said granular material; (c) heating said granular material contained in said first vessel to a first temperature; and (d) heating said granular material contained in said second vessel to a second temperature, and said temperature being higher than said first temperature.

BRIEF DESCRIPTION OF THE DRAWINGS

Reference will now be made, by way of example, to the accompanying drawings which show a preferred embodiment of the present invention, and in which.

DETAILED DESCRIPTION OF THE PREFERRED EMBODIMENTS

Figure 1:
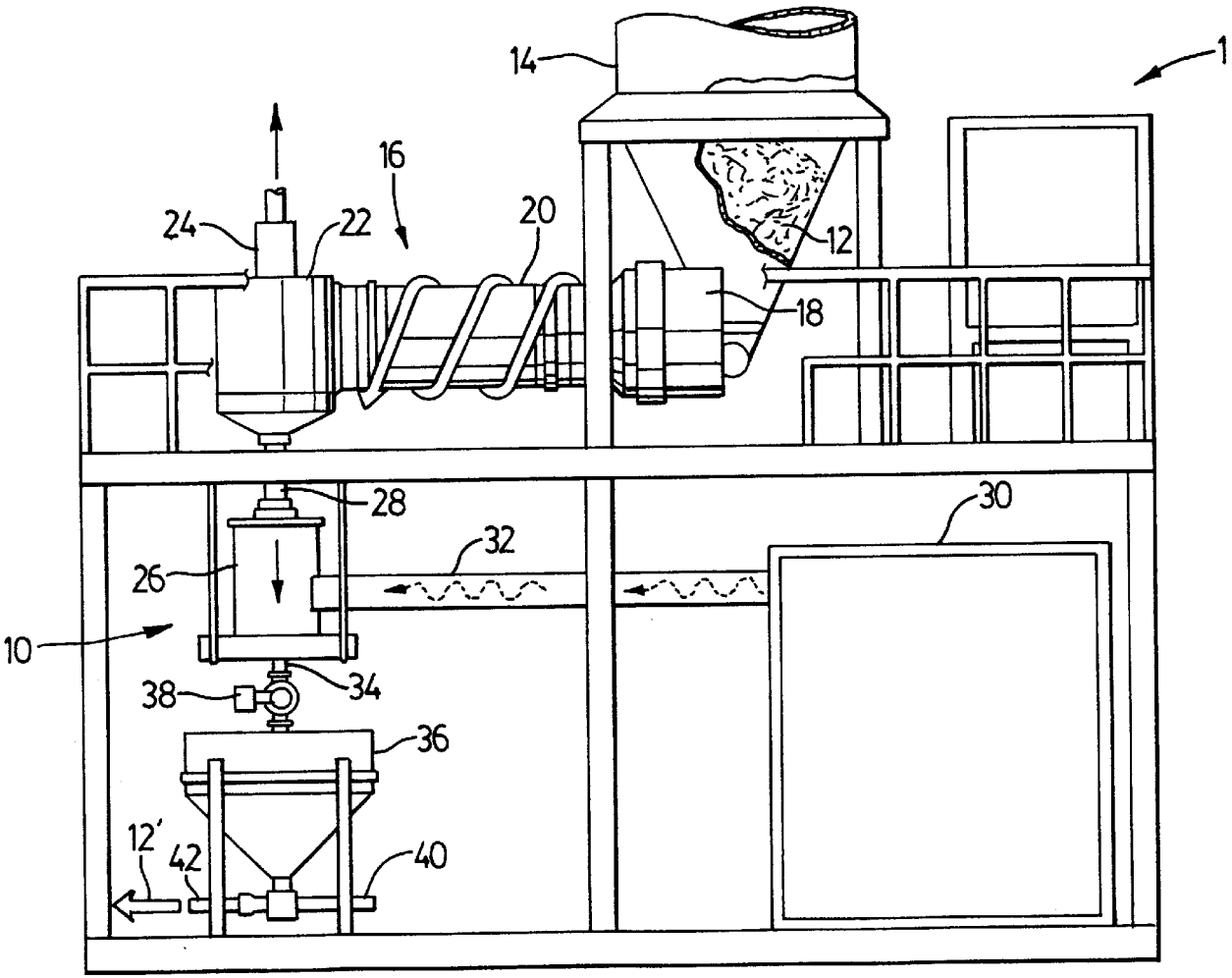
FIG. 1 shows an apparatus according to the present invention for processing carbon from a carbon-in-pulp process.

Reference is first made to FIG. 1 which shows in diagrammatic form a continuous process system 1 utilizing an apparatus 10 according to the present invention for processing or reactivating carbon from a "carbon-in-pulp" process.

The carbon-in-pulp or CIP process is used in metallurgical processing, for example, in the extraction of gold from ore. While the apparatus 10 according to the present invention is described in the context of processing carbon used in a CIP process, the apparatus has wider applicability to heat processing of other types of carbon and granular materials such as ceramic and glass powders.

In the application of the present invention to a CIP process, spent carbon is regenerated by the apparatus 10. The spent carbon comprises carbon which was used in the processing of ore (e.g. gold) and has been contaminated with impurities. The apparatus 10 according to the present invention reactivates the carbon by burning the impurities which have clogged the pores in the carbon.

The apparatus 10 according to the present invention is shown in a CIP process in FIG. 1. Spent carbon 12 is stored in a feed hopper 14. The feed hopper 14 feeds the spent carbon 12 into a pre-dryer 16 which includes a hot-air furnace 18. The hot-air furnace 18 may have a blower for forcing heated air over the carbon 12. The function of the pre-dryer 16 is to remove residual moisture (approximately 10% moisture content) in the spent carbon 12. To uniformly expose the carbon 12 to the heat generated by the furnace 18, the pre-dryer 16 preferably includes a rotating chamber 20. In some processing applications, the hot-air pre-dryer 16 may not be needed and the material is fed directly to a microwave chamber as will be described below with reference to FIG. 2.

As shown in FIG. 1, the output, i.e. pre-dried carbon, from the pre-dryer 16 goes into a holding bin 22. The holding bin 22 has an exhaust port 24 for releasing excess heat and/or moisture from the carbon 12. The holding bin 22 is coupled to a microwave reactivation chamber 26 through an input tube 28. Preferably, the microwave reactivation chamber 26 is located below the holding chamber 22 in a vertical arrangement. Improvements according to the present invention relate to an arrangement that utilizes gravitational flow of the carbon 12 which results in gentler handling of the carbon 12 and therefore a better quality reactivated carbon product 12'. In conventional rotary kiln reactivation apparatus, the rotary action during reactivation in the principal heating chamber tends to grind the material and thereby destroy a portion of the carbon. This problem is exacerbated by the long exposure times required for reactivation in the conventional kilns. Such conventional rotary kilns typically include a blower to blow the heated air across the rotating carbon in order to uniformly heat the carbon. The apparatus according to the present invention overcomes these disadvantages.

Figure 2:
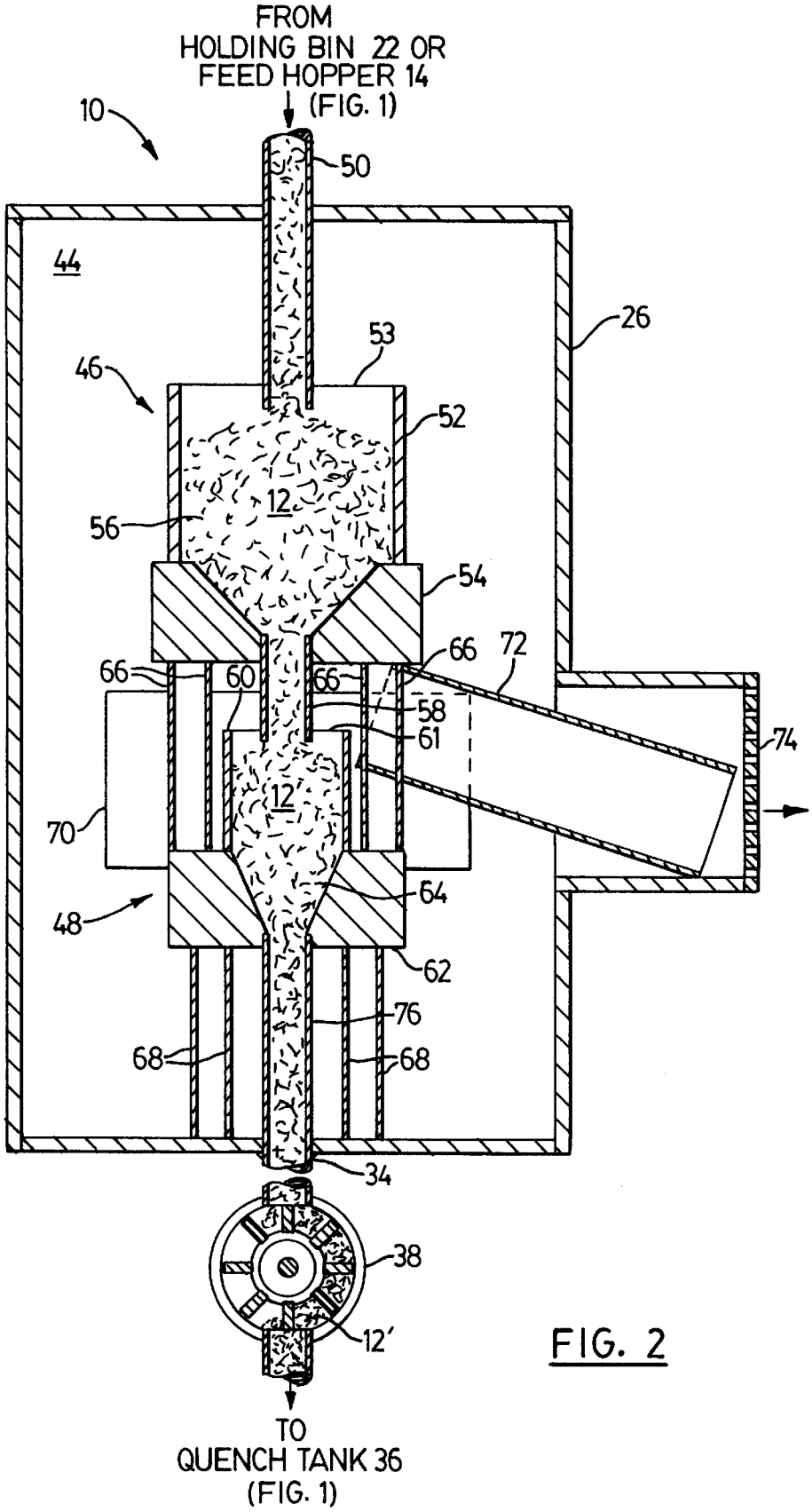
FIG. 2 is a cross-sectional view of an apparatus according to the present invention.

As shown in FIG. 2, the microwave reactivation chamber 26 is coupled to a microwave generator 30 through a waveguide 32. The microwave chamber 26 includes a discharge tube 34 which is connected to a quench tank 36 through a control valve 38. The quench tank 36 has an input tube 40 connected to a fresh water supply (not shown). The quench tank 36 serves to quench or cool the reactivated carbon 12' which has been heated in the microwave chamber 26. The reactivated carbon 12' is released from the quench tank 36 through an output tube 42.

Reference is next made to FIG. 2 which shows the apparatus 10 in more detail. The apparatus 10 comprises the microwave reactivation chamber 26 which defines a cavity 44. Because of the presence of potentially corrosive materials, the microwave chamber 26 is preferably formed from stainless steel Inside the cavity 44 there are first and second heating chambers denoted by reference numerals 46 and 48 respectively. The first heating chamber 46 is intended to dry and preheat the material e.g. carbon 12. In the regeneration of carbon 12, the first heating chamber 46 dries the carbon 12 to approximately 1% moisture content and preheats the carbon 12 up to a temperature of approximately 200° C. The second heating chamber 48 then rapidly heats the material to the reactivation temperature, approximately 700° C. for reactivating carbon used in CIP process. The heating control in the first and second chambers 46,48 may be implemented using a suitable industrial controller (not shown) as will be within the understanding of one skilled in the arts. For carbon, the processing temperatures range from 400° C. to 800° C., and a temperature above 700° C. is preferred for reactivating carbon for use in a CIP process. Because the apparatus 10 according to the present invention can quickly and non-destructively heat the carbon 12 to temperatures in the range of 800° C. it presents a significant improvement over the prior art rotary kiln devices.

As shown in FIG. 2, the apparatus 10 includes a feed tube 50 which is coupled to the output of the holding bin 22 (FIG. 1) and provides a supply of carbon 12 to the first heating chamber 46. Preferably, the feed tube 50 is made from an industrial grade quartz material or other suitable high temperature material which is transparent to microwave energy. The first heating chamber 46 comprises a vessel 52 having an open top 53 and a base 54 which define a preheating zone 56 for drying (i.e. reducing the moisture content) and preheating the carbon 12. As shown in FIG. 2, the feed tube 50 is positioned above the open top 53 of the preheating vessel 52 and carbon 12 flows from the feed tube 50 into the vessel 52. The open top 53 allows the moisture to escape from the vessel 52 without condensing around the feed tube 50.

The second heating chamber 48 is coupled to the output of the first heating chamber 46 through another feed tube 58. Preferably, the feed tube 58 is made from a quartz material or other suitable microwave transparent material. The second heating chamber 48 also comprises a vessel 60 having an open top 61 and a base 62 which together define a high temperature heating zone 64. Preferably, the vessels 52,60 are made of quartz and the bases 54,62 are made from a suitable material such as casted ceramic. The open top 61 allows the moisture, impurities and volatile gases released by the carbon during the high temperature heating to leave the vessel 60 and separate from the carbon 12'. The impurities and volatile gases which may form are exhausted from the interior of the microwave chamber 26 by an exhaust duct 72. It is a feature of the apparatus 10 that the interior of the microwave chamber 26 need not be filled with an inert gas.

As shown in FIG. 2, the base 54 for the first heating vessel 52 is supported on the base 62 of the second heating vessel 60 by a number of support members 66. The base 62 for the second heating vessel 60 is supported in the microwave chamber 26 by another set of support members 68. Preferably, the support members 66,68 are made of a suitable quartz material or other microwave transparent material. In the preferred embodiment of the present invention, the first and second heating chambers 46,48 are arranged in a vertical orientation in order to allow the force of gravity to assist in the flow of material through the chambers of the apparatus 10. Because the application of mechanical forces to move the material through the apparatus 10 are minimized, the apparatus 10 according to the present invention can reduce the amount of material which is destroyed during the reactivation process when compared to conventional rotary kilns. The features of the vertically oriented open top heating vessels of the apparatus 10 also overcome the condensation build-up and clogging associated with known vertical kiln furnaces.

Referring still to FIG. 2, the microwave energy received from the microwave generator 30 is radiated throughout the cavity 44 and vessels 52,60 through a waveguide port 70. The microwave generator 30 (FIG. 1) supplies microwave energy to the chamber 26 through the waveguide port 70. The microwave generator 30 comprises conventional technology, and may include generators producing radiation in the range 895 MHz to 6000 Mhz. The microwave reactivation chamber 26 also includes the exhaust duct 72 and exhaust port 74 for exhausting excess heat, moisture, impurities and volatile gases which are released from the carbon. The exhaust port 74 can conveniently be formed from the same material as the microwave chamber 26. The exhaust port 74 may also be fitted with a suitable microwave shield.

According to the invention, the drying and preheating vessel 52 is larger than the heating vessel 60 and the material, e.g. carbon 12, is processed by the apparatus 10 as a continuous flow. It is another feature of the present invention that the preheating vessel 52 is positioned at a lower microwave energy zone inside the cavity 44, and therefore less microwave radiation is absorbed by the material (on a per unit basis) in the preheating vessel 52 than in the smaller high temperature heating vessel 60. The high temperature heating vessel 60, on the other hand, is positioned in a higher microwave energy zone inside the cavity 44. By positioning the second vessel 60 in the high density portion of the microwave field, the carbon 12 can be rapidly heated to the reactivation temperature. Thus according to the present invention, it is possible to control the heating in the two vessels 52,60 based on their relative sizes, their respective locations in the microwave energy field, and the flow rate of the material. The improvement with this arrangement is the ability to provide a continuous process for reactivating the carbon or other material without the need of maintaining the heating chamber at an elevated temperature during the idle periods as is done in conventional kilns. Additional improvements relate to rapid heating of the material, e.g. carbon, to the processing temperature, e.g. 700° C. A further improvement relates to the elimination of the need to rotate the material inside the heating chamber in order to uniformly expose to heat energy as required in conventional rotary kilns.

The distribution of the microwave energy field in the cavity 44 depends on a number of factors which are within the understanding of the those skilled in the art. These factors include the dimensions of the chamber 26, the geometry of the cavity 44, the output power and wavelength from the microwave generator 30.

The flow of material, e.g. carbon 12, through the apparatus 10 is controlled by the control valve 38 and the size of the feed tubes 50,58. The control valve 38 is preferably a rotary gate valve which can withstand high temperatures.

The output of the high temperature heating vessel 60 is suitably coupled to the control valve 38 through a discharge tube 76. Preferably, the discharge tube 76 is made from quartz or other suitable microwave transparent material. The output of the control valve 38 is coupled to the quench tank 36 as shown in FIG. 1. As described above, the quench tank 36 serves to cool the reactivated carbon 12' received from the heating chamber 64. The cooled carbon 12' is then available for reuse in the metallurgical processing.

In operation, the carbon 12 is continuously fed into the first heating vessel 52 and exposed to microwave radiation which preheats and dries the carbon 12 to lower the moisture content. The carbon 12 from the first heating vessel 52 is continuously fed to the second heating vessel 60. The second heating vessel 60 also receives microwave radiation and because it is located in a higher energy zone high temperature heating is quickly achieved. The continuous flow of carbon 12 through the first and second heating vessels 52,60 is controlled by the control valve 38, e.g. rotary gate valve.

The present invention may be embodied in other specific forms without departing from the spirit or essential characteristics thereof. Therefore, he presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An apparatus for continuous processing of granular material, said apparatus comprising:

(a) a microwave chamber having a port for receiving microwave energy and an inlet for receiving said granular material and an outlet for releasing granular material;

(b) a first vessel located inside said microwave chamber and in communication with said inlet for receiving said granular material and exposing said granular material to microwave energy;

(c) said vessel including an output for releasing said granular material;

(d) a second vessel positioned in said microwave chamber and in communication with the output of said first vessel for receiving granular material from said first vessel and heating said granular material to a second temperature and said second vessel having an output coupled to said outlet for releasing said granular material; and (e) a control valve coupled to said outlet for controlling the flow of granular material through said first and second vessels.

2. The apparatus as claimed in claim 1, wherein said first vessel and said second vessel are arranged in a vertical orientation so that gravity assists the flow of granular material from said first vessel to said second vessel.

3. The apparatus as claimed in claim 1, wherein said microwave chamber includes a zone of high microwave energy concentration and said second vessel is positioned in said zone.

4. The apparatus as claimed in claim 1, 2 or 3, wherein said first vessel has a greater capacity than said second vessel.

5. The apparatus as claimed in claimed 3, wherein said granular material comprises carbon.

6. The apparatus as claimed in claimed 5, wherein said second temperature is in the range of 400° C. to 800° C.

7. The apparatus as claimed in claim 3, wherein said control valve comprises a rotary gate valve.

8. The apparatus as claimed in claim 1, further including a microwave generator for supplying said microwave energy to said microwave chamber.

9. The apparatus as claimed in claim 1, further including a hopper connected to the inlet of said microwave chamber for providing a continuous supply granular material.

10. The apparatus as claimed in claim 1, wherein said microwave chamber includes a zone of microwave energy concentration.

11. The apparatus as claimed in claim 10, wherein said vessel is located in said zone of microwave energy concentration.

12. An apparatus for continuous processing of granular material, said apparatus comprising:

(a) a microwave chamber having a port for receiving microwave energy and an inlet for receiving said granular material and an outlet for releasing granular material;

(b) a first vessel located inside said microwave chamber and in communication with said inlet for receiving said granular material and exposing said granular material to microwave energy for heating said granular material to a first temperature;

(c) a second vessel located inside said microwave chamber and in communication with the output of said first vessel for receiving granular material from said first vessel and heating said granular material to a second temperature, and having an output for releasing said granular material and said output being in communication with said outlet;

(d) means for producing a zone of microwave energy concentration inside said microwave chamber and said second vessel being located in said zone of microwave energy concentration; and (e) a control valve coupled to said outlet for controlling the flow of granular material through said first and second vessels.

13. The apparatus as claimed in claim 12, wherein said first vessel and said second vessel are arranged in a vertical orientation so that gravity assists the flow of granular material from said first vessel to said second vessel.

14. A method for heating a granular material in a microwave chamber having first and second vessels and a port for receiving microwave energy and an input for receiving the granular material and an output for releasing the granular material, said method comprising the steps of:

(a) continuously feeding granular material to said first vessel and feeding granular material from said first vessel to said second vessel;

(b) supplying microwave energy to said microwave chamber for heating said granular material;

(c) heating said granular material contained in said first vessel to a first temperature; and (d) heating said granular material contained in said second vessel to a second temperature, and said temperature is higher than said first temperature.

* * * * *